US007673671B2

(12) United States Patent
Okazawa et al.

(10) Patent No.: US 7,673,671 B2
(45) Date of Patent: Mar. 9, 2010

(54) AIR CONDITIONER

(75) Inventors: Hiroki Okazawa, Tokyo (JP); Seiji Hirakawa, Tokyo (JP); Toshiaki Yoshikawa, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 1017 days.

(21) Appl. No.: 10/573,413

(22) PCT Filed: Sep. 21, 2004

(86) PCT No.: PCT/JP2004/013733

§ 371 (c)(1),
(2), (4) Date: Mar. 27, 2006

(87) PCT Pub. No.: WO2005/093330

PCT Pub. Date: Oct. 6, 2005

(65) Prior Publication Data

US 2007/0084235 A1 Apr. 19, 2007

(30) Foreign Application Priority Data

Mar. 25, 2004 (JP) ..... 2004-089607

(51) Int. Cl.
*F24H 3/06* (2006.01)

(52) U.S. Cl. ..... 165/122; 165/53

(58) Field of Classification Search ..... 165/47, 165/53, 121, 122, 124, 125
See application file for complete search history.

(56) References Cited

U.S. PATENT DOCUMENTS 5,573,059 A 11/1996 Hamamoto et al.
6,341,643 B1 * 1/2002 Osakabe ..... 165/122

FOREIGN PATENT DOCUMENTS

| | | |
|---|---|---|
| JP | 05-003814 U | 1/1993 |
| JP | 07-260181 | 10/1995 |
| JP | 8-200283 | 8/1996 |
| JP | 11-148706 | 6/1999 |
| JP | 11-281080 | 10/1999 |
| JP | 2000-009083 | 1/2000 |
| JP | 2000-329364 | 11/2000 |
| JP | 2000-329364 A | 11/2000 |
| JP | 2001-059628 | 3/2001 |
| JP | 2003-202119 | 7/2003 |

OTHER PUBLICATIONS

Supplementary European Search Report dated Oct. 25, 2007.

* cited by examiner

*Primary Examiner*—Ljiljana (Lil) V Ciric
(74) *Attorney, Agent, or Firm*—Buchanan Ingersoll & Rooney PC

(57) ABSTRACT

To provide an air conditioner capable of reducing an input power and a rotational speed of a fan motor necessary for obtaining a predetermined flow rate from an indoor unit. An air conditioner includes an indoor unit 8 having at least one inlet 6 and one outlet 8; a cross-flow fan 1 connected to a fan motor; a front heat exchanger 2; and a back heat exchanger 3, wherein an installation angle α of the front heat exchanger 2 positioned above the rotational center of the cross-flow fan 1 relative to the horizon is 65°≦α≦90°, a point of the back heat exchanger 3 closest to the front heat exchanger 2 is located adjacent to the front heat exchanger 2 from the rotational center of the cross-flow fan 1, and an outlet angle β2 of a blade of the cross-flow fan 1 is 22°≦β2≦28°.

9 Claims, 14 Drawing Sheets

AIR CONDITIONER

TECHNICAL FIELD

The present invention relates to air conditioners, and in particular, it relates to an air-conditioner having a cross-flow fan capable of reducing the input of a fan motor necessary for obtaining a predetermined airflow from an indoor unit.

BACKGROUND ART

In conventional air conditioners, aerodynamic characteristics of the cross-flow fan and the heat transfer performance of a heat exchanger have been improved by changing blade shapes of the cross-flow fan without changing the arrangement of the heat exchangers or by changing the arrangement of the heat exchangers without changing the blade shapes of the cross-flow fan.

In the conventional air-conditioner having the re-arranged heat exchangers without changing the blade shapes of the cross-flow fan, a front heat exchanger and a back heat exchanger are arranged above the cross-flow fan by combining them in a λ-shape so as to improve the performance of the indoor unit by bringing out the respective heat-transfer performance of the front and back heat exchangers to the utmost (Patent Document 1).

[Patent Document 1] Japanese Unexamined Patent Application Publication No. 2000-329364, [0009] to [0015], FIG. 1

DISCLOSURE OF THE INVENTION

Problems to be Solved by the Invention

In the conventional air-conditioning unit, when the blade shapes of the cross-flow fan are changed without changing the arrangement of the heat exchangers, an air inflow direction in a suction region of the cross-flow fan is defined by the arrangement of the heat exchangers, so that the blade is shaped so as not to stall in the suction region and so as difficult to gush in a delivery region.

On the other hand, when the arrangement of the heat exchangers is changed without changing the blade shapes of the cross-flow fan, an air-inflow direction in a suction region of the cross-flow fan is varied depending on the arrangement of the heat exchangers and an attack angle of the blades is also changed so as not to have optimum blade shapes.

In such a manner, in the conventional air-conditioning units, since the arrangement of the heat exchangers is changed without changing the blade shapes, of the cross-flow fan or the blade shapes of the cross-flow fan are changed without changing the arrangement of the heat exchangers, there has been a problem that the input power and the revolution speed of a fan motor required for obtaining a predetermined airflow are large.

The present invention has been made in order to solve the problems described above, and it is an object thereof to provide an air-conditioning unit capable of reducing the input power and the revolution speed of a fan motor required for obtaining a predetermined airflow.

Means for Solving the Problems

An air conditioner according to the present invention includes an indoor unit having at least one inlet and one outlet; a cross-flow fan connected to a fan motor; a front heat exchanger; and a back heat exchanger, wherein an installation angle α of the front heat exchanger positioned above the rotational center of the cross-flow fan relative to the horizon is $65° \leqq \alpha \leqq 90°$, a point of the back heat exchanger closest to the front heat exchanger is located adjacent to the front heat exchanger from the rotational center of the cross-flow fan, and an outlet angle β2 of a blade of the cross-flow fan is $22° \leqq \beta 2 \leqq 28°$.

Advantages

According to the present invention, the installation angle α of a front heat exchanger arranged above the rotational center of a cross-flow fan relative to the horizon is $65° \leqq \alpha \leqq 90°$, the point of a back heat exchanger closest to the front heat exchanger is positioned adjacent to the front heat exchanger from the rotational center of the cross-flow fan, and the outlet angle β2 of a blade of the cross-flow fan is $22° \leqq \beta 2 \leqq 28°$, so that the input power and the rotational speed of a fan motor necessary for obtaining a predetermined flow rate can be reduced.

REFERENCE NUMERALS

1: cross-flow fan, 2: front heat exchanger, 3: back heat exchanger, 4: installation angle, 6: air inlet, 7: air outlet, 8: indoor unit, 10: fan suction region, 12: attack angle, 13: blade, 14: suction surface, 15: pressure surface, 21: inlet angle, 38: fan delivery region, 40: region in vicinity of stabilizer, 43, 44: auxiliary heat exchanger, 48: distance

BEST MODE FOR CARRYING OUT THE INVENTION

First Embodiment

Figure 1:
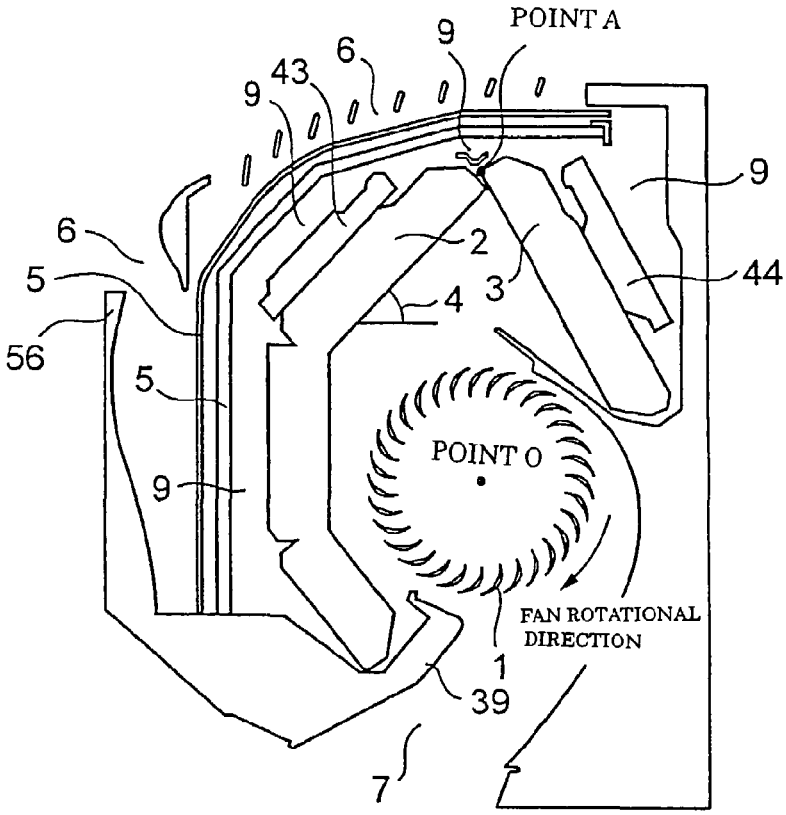
FIG. 1 is a structural drawing of an air conditioner according to a first embodiment of the present invention.
Figure 2:
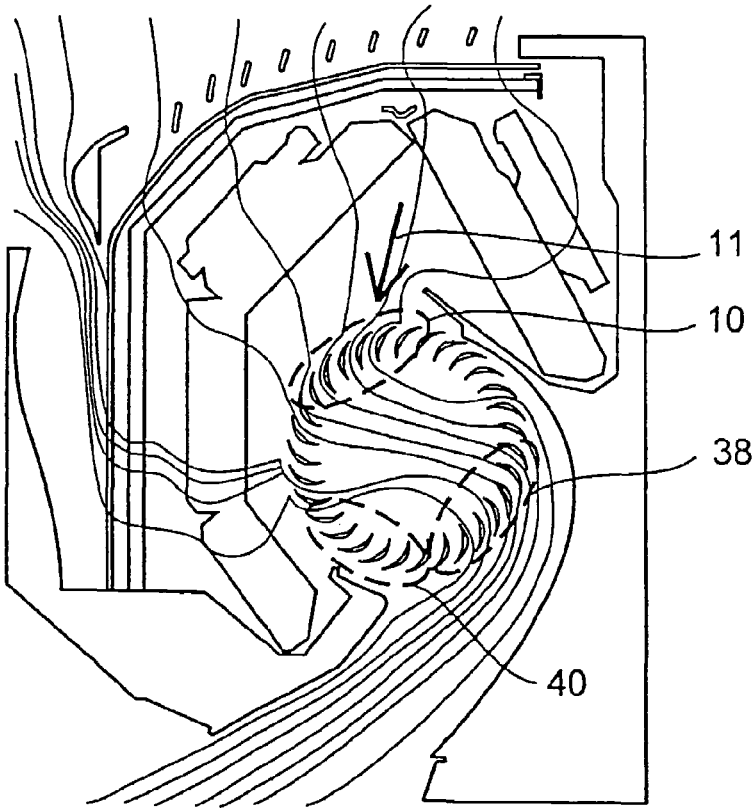
FIG. 2 is a structural drawing of the first embodiment according to the present invention showing flow path lines inside the air conditioner.
Figure 3:
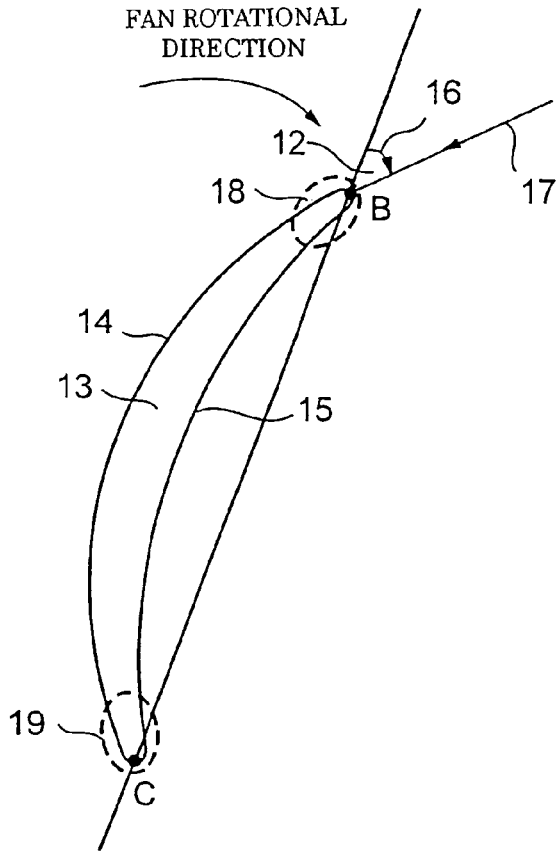
FIG. 3 is a structural drawing of a blade of a cross-flow fan showing the structure of the first embodiment according to the present invention.
Figure 4:
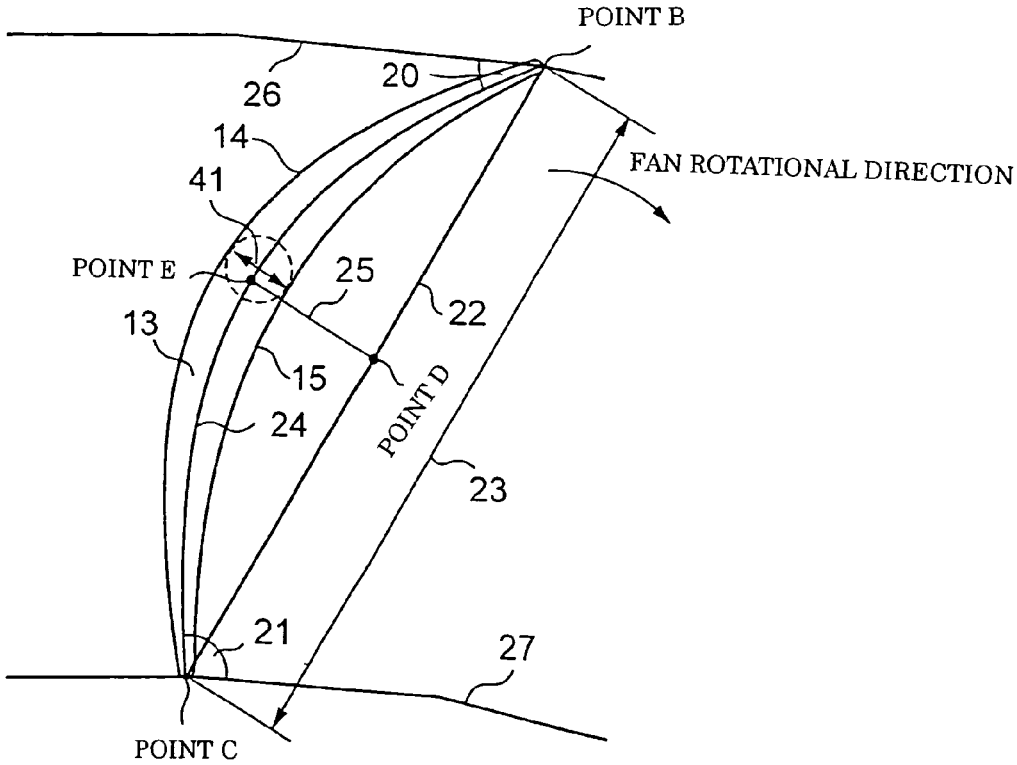
FIG. 4 is a structural drawing of the blade of the cross-flow fan showing the structure of the first embodiment according to the present invention.

FIG. 1 is a sectional view of an indoor unit for an air conditioner according to a first embodiment of the present invention; FIG. 2 is a drawing showing air path lines within the indoor unit of the air conditioner according to the first embodiment of the present invention; and FIGS. 3 and 4 are structural drawings of a blade of a cross-flow fan showing the structure according to the first embodiment of the present invention.

In FIG. 1, an indoor unit 8 includes air inlets 6 formed on the front face and the top face of a front panel 56, an air outlet 7 formed on the bottom surface of the indoor unit 8, a cross-flow fan 1 arranged corresponding to the air outlet 7 of the indoor unit 8, a front heat exchanger 2 with upper and lower marginal portions retracted respectively arranged so as to oppose the air inlets 6 on the front and upper faces, a back heat exchanger 3 arrange in the rear of the front heat exchanger 2 at a position where its upper marginal portion comes close to the upper marginal portion of the front heat exchanger 2 so as to oppose the air inlet 6 on the upper face and to be inclined in a direction in that its lower marginal portion is separated from the front heat exchanger 2, an air-cleaning filter 5 arranged inside the front panel 56, a stabilizer 39 for letting air generated from the cross-flow fan 1 to flow smoothly, an auxiliary heat exchanger 43 provided on the front heat exchanger 2, and an auxiliary heat exchanger 44 provided on the back heat exchanger 3. The rotational-center point of the cross-flow fan 1 is indicated by O; the point of the back heat exchanger 3 closes to the front heat exchanger 2 is denoted by A; and the arrangement state of the front heat exchanger 2 is shown by an angle 4 of the upper portion of the front heat exchanger 2.

Then, the operation of the indoor unit 8 will be described with reference to FIGS. 1 to 11.

FIG. 2 is a drawing showing air path lines within the indoor unit 8, wherein a fan suction region 10 is part of a suction region of the cross-flow fan 1; a delivery region 38 is part of a delivery region of the cross-flow fan 1; a region 40 denotes a region 40 in the vicinity of the stabilizer 39; and air 9 flows in the suction region 10 from the direction of the back heat exchanger 3 as shown in arrow 11. In FIG. 3, reference numeral 13 denotes a blade of the cross-flow fan; numeral 14 a suction surface of the blade 13; numeral 15 a pressure surface; reference character B an end point of a leading edge 18 of the blade 13; and character C an end point of a trailing edge 19. An attack angle 12 is defined by a straight line BC and a relative-speed vector 17 of the air 9 at point B, and arrow 16 is designated to be positive.

In FIG. 4, reference numeral 20 denotes an outlet angle; numeral 21 an inlet angle; numeral 22 a blade chord; numeral 23 chord length representing the length of the blade chord 22; numeral 24 a camber line; character E an intersecting point of a perpendicular line from a point D on the blade chord 22 and the camber line 24; numeral 25 a maximum warp representing a maximum length of a line segment DE; numeral 41 a maximum blade thickness; character O a rotational center of the cross-flow fan 1; numeral 26 a circle passing a point B; numeral 27 a circle about the rotational center O of the cross-flow fan 1 passing a point C, wherein the radius of the circle 26 is larger than that of the circle 27; the outlet angle 20 is defined by the camber line 24 and the circle 26; the inlet angle 21 is defined by the camber line 24 and the circle 27; the blade chord 22 is a line segment BC; and the maximum blade thickness 41 is the maximum diameter of a circle touching with the suction surface 14 and the pressure surface.

In the structure described above, when the cross-flow fan 1 is rotated by the operation of a fan motor (not shown), the air 9 existing outside the indoor unit 8 is sucked from the air inlets 6 so as to blow out from the air outlet 7 via the air-cleaning filter 5, the front heat exchanger 2, the back heat exchanger 3, and the cross-flow fan 1. The air-cleaning filter 5 removes dust containing in the air 9 and the front heat exchanger 2 and the back heat exchanger 3 exchange heat with the air 9 so as to cool the air 9 in a cooling period and heat the air 9 in a heating period.

Figure 5:
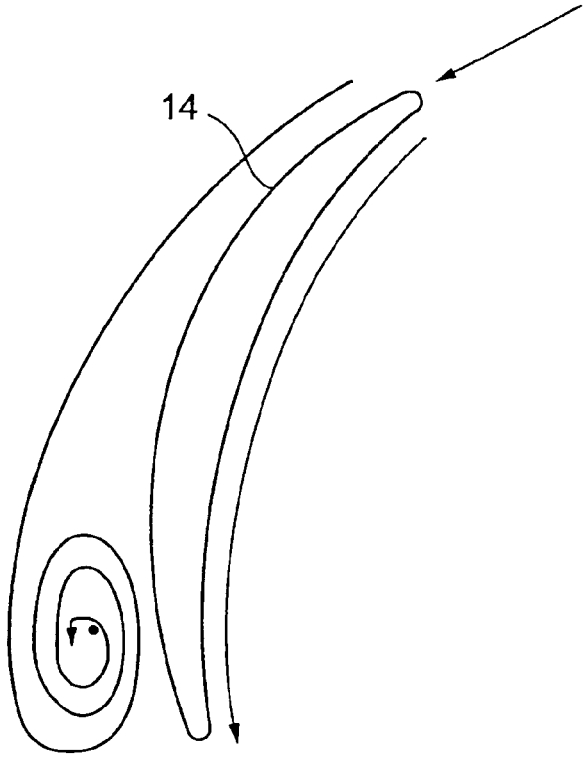
FIG. 5 is a relative-speed distribution drawing of the blade of the cross-flow fan showing the structure of the first embodiment according to the present invention.

Then, the relative speed distribution of the blade 13 of the cross-flow fan 1 will be described with reference to FIG. 5. FIG. 5 shows the state in that an attack angle is large in the fan suction region 10 and separation is generated on the suction surface 14. There is a problem that if the separation is generated on the suction surface 14 in such a manner, the input power and the revolution speed of the fan motor required for obtaining a predetermined airflow become large.

There are methods for suppressing the separation on the suction surface 14 of a method for allowing the air 9 to flow in the fan suction region 10 from the direction of the front heat exchanger 2 not from the back heat exchanger 3 as shown in FIG. 2, and a method for modifying the shape of the blade 13, such as reducing the outlet angle 20 of the blade 13. However, since the latter method has a shape in that air is difficult to flow in the delivery region, there is a problem that the input power of the fan motor and the revolution speed of the fan required for obtaining a predetermined airflow are large, so that the method for allowing the air to flow in the fan suction region 10 from the direction of the front heat exchanger 2 is preferable.

Figure 6:
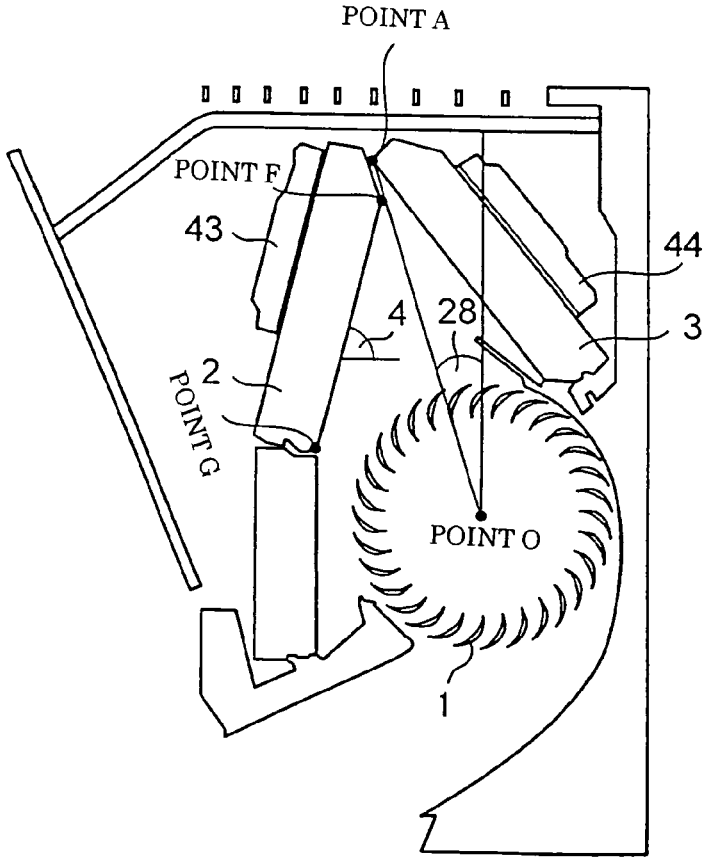
FIG. 6 is a structural drawing of the air conditioner according to the first embodiment of the present invention.
Figure 7:
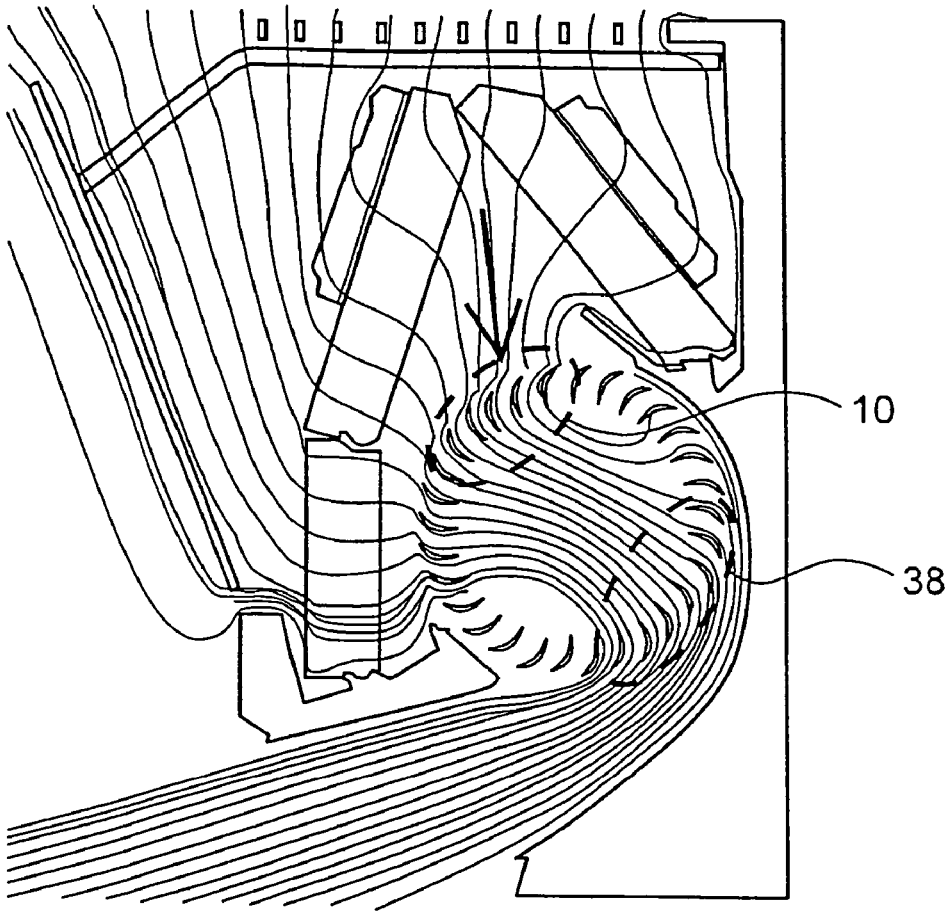
FIG. 7 is a structural drawing of the first embodiment according to the present invention showing flow path lines of the air conditioner.
Figure 8:
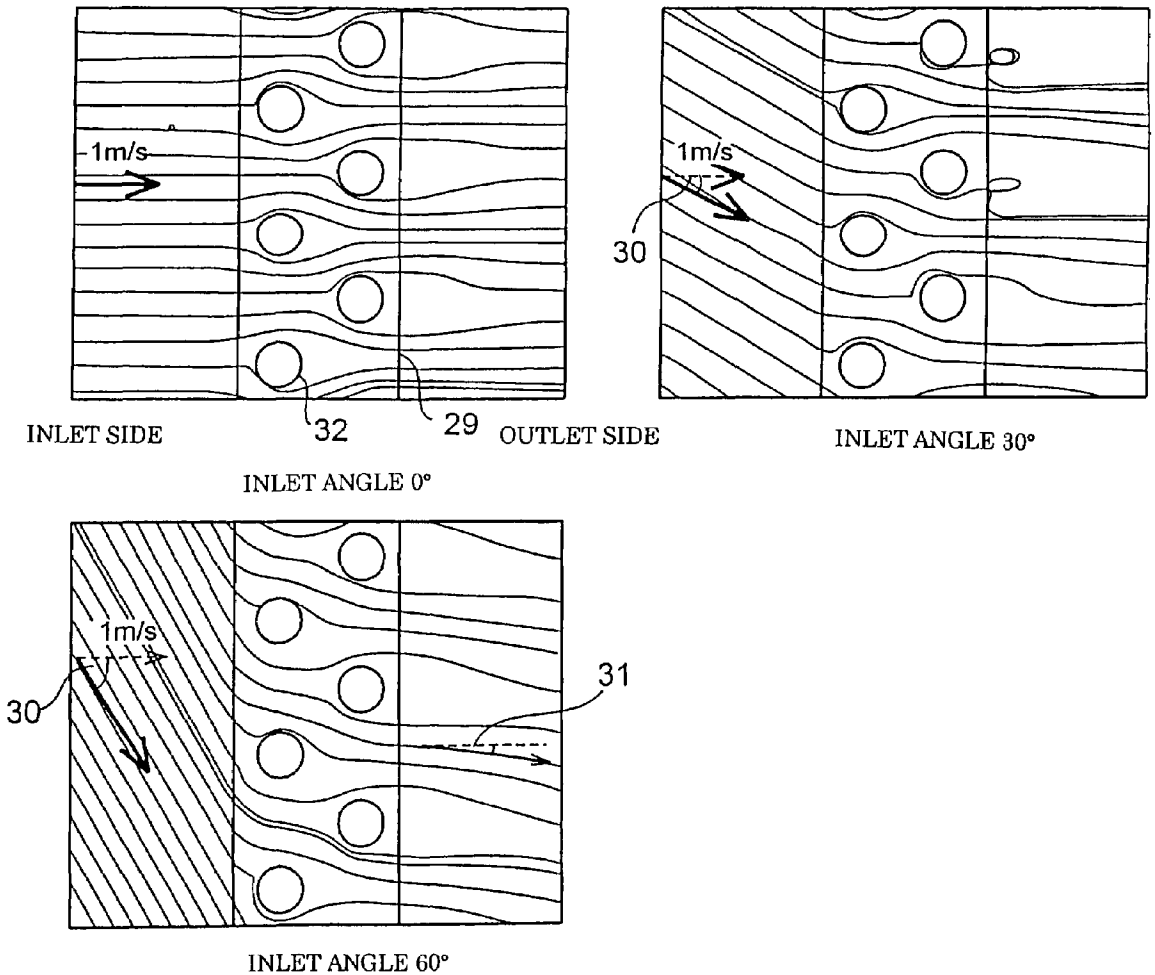
FIG. 8 is a structural drawing of the first embodiment according to the present invention showing flow path lines inside a heat exchanger.
Figure 9:
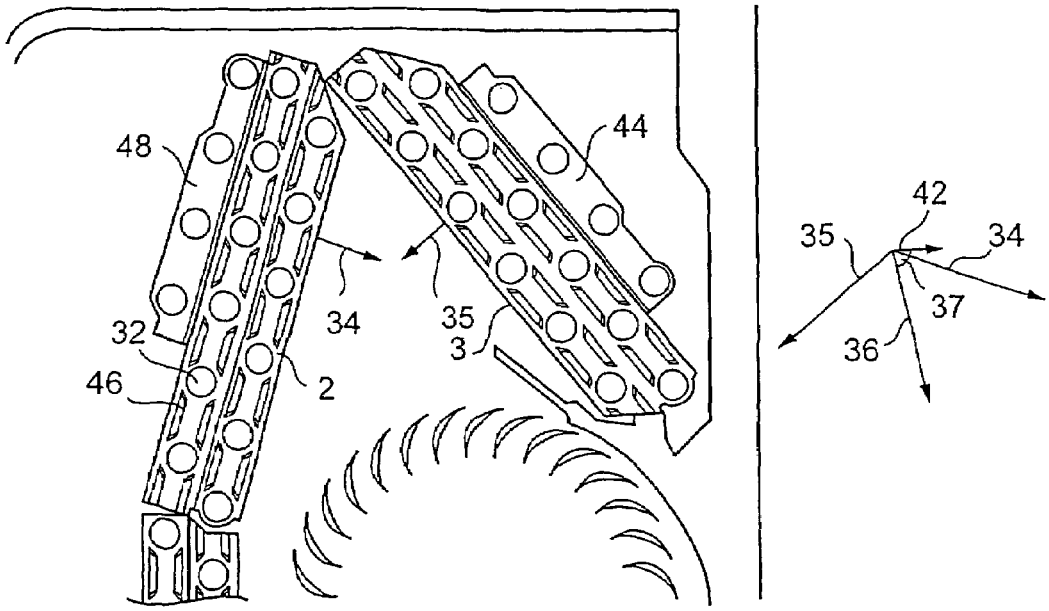
FIG. 9 is an explanatory view of the structure of the first embodiment according to the present invention illustrating a flow downwind the heat exchanger.

Next, the method for allowing the air to flow in the fan suction region 10 from the direction of the front heat exchanger 2 will be described with reference to FIGS. 6 to 9. FIG. 6 is a structural drawing of the air conditioner according to the first embodiment of the present invention; FIG. 7 shows air path lines of the air conditioner; FIG. 8 is a drawing showing the relationship between the inlet angle and the outlet angle into and out of the heat exchanger; and FIG. 9 is an explanatory view of air flow in the lee side of the heat exchanger.

FIG. 6 shows an example of the arrangement of the front heat exchanger 2 and the back heat exchanger 3 in that an installation angle 4 of the front heat exchanger 2 located above the rotational center O of the cross-flow fan 1 is 65° or more relative to the horizon and a point of the back heat exchanger 3 closest to the front heat exchanger 2 is positioned adjacent to the front heat exchanger 2 from the rotational center O of the cross-flow fan 1. Reference numeral 28 denotes an angle defined by the straight line OA and a perpendicular from the point O. In FIG. 6, the angle 4 is 73.6°; and the angle 28 is 17.6°.

Air path lines of the air conditioner in this structure, as shown in FIG. 7, are flowing into the fan suction region 10 from the direction of the front heat exchanger 2 differently from those shown in FIG. 2.

The reason that air is flowing into the fan suction region 10 from the direction of the front heat exchanger 2 in such a manner will be described. First, the relationship between the inlet angle and the outlet angle into and out of the heat exchanger will be described with reference to FIG. 8. FIG. 8 includes drawings showing three-dimensional analysis results of an outlet angle 31 of a model heat exchanger 29 when the heat exchanger 29 is placed in a wind tunnel so as to change an inlet angle 30. As shown in FIG. 8, the outlet angles 31 are small not depending on the inlet angles 30, and air flows out substantially perpendicularly to the heat exchanger 29. This is due to interaction between refrigerant piping 32 and fins (not shown).

Then, the reason that air is flowing into the fan suction region 10 from the direction of the front heat exchanger 2 will be described with reference to FIG. 9. FIG. 9 is an explanatory view of the reason that air is flowing into the fan suction region 10 from the direction of the front heat exchanger 2 in FIG. 7.

As shown in FIG. 8, the outlet angle 31 is substantially perpendicularly to the model heat exchanger 29 not depending on the inlet angles 30 of the model heat exchanger 29, and a velocity vector 34 perpendicular to the front heat exchanger 2 and a velocity vector 35 perpendicular to the back heat exchanger 3 are considered. In the vector sum 36 of the velocity vector 34 and the velocity vector 35, with decreasing an angle 37 defined by the vector sum 36 and the horizontal component vector 42 of the vector sum 36 in a direction of the vector sum 36 extending from the front heat exchanger 2 toward the fan suction region 10, in the fan suction region, air is liable to flow into the suction region 10 from the direction of the front heat exchanger 2. To reduce the angle 37, it is preferable that the installation angle 4 of the front heat exchanger 2 be increased and the angle 28 (see FIG. 6) defined by the straight line OA and the perpendicular passing the point O be increased.

Figure 10:
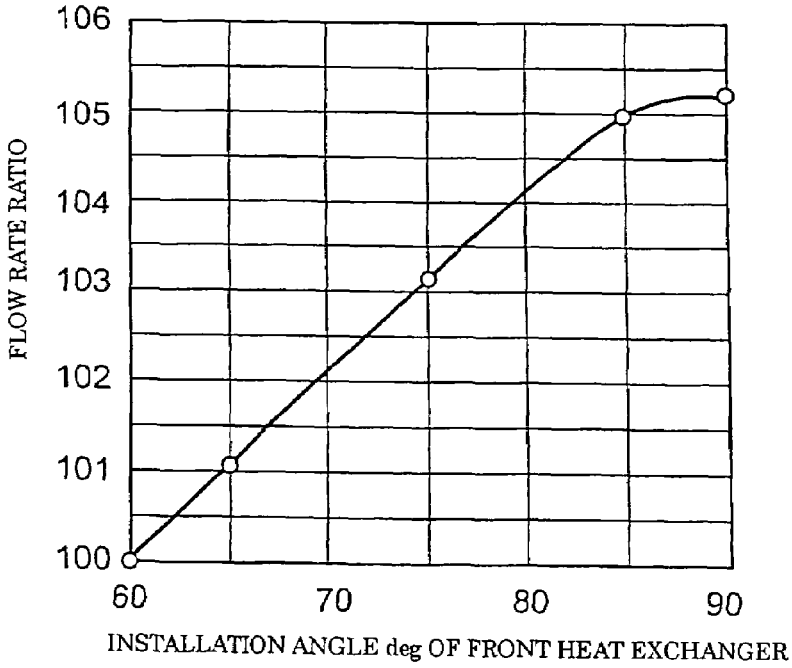
FIG. 10 is a drawing of the structure of the first embodiment according to the present invention showing the relationship between an airflow rate and an installation angle of the heat exchanger.
Figure 11:
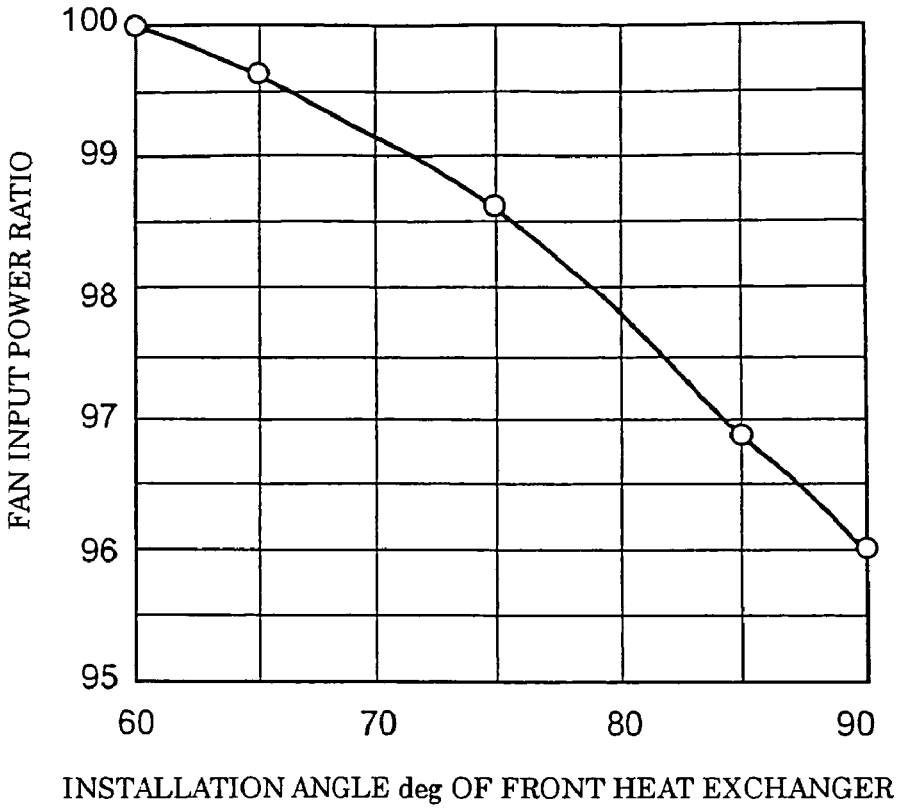
FIG. 11 is a drawing of the structure of the first embodiment according to the present invention showing the relationship between an input power of a fan motor and an installation angle of the heat exchanger.

The experimental results regarding to the installation angle 4 of the front heat exchanger 2 will be described with reference to FIGS. 10 and 11. FIG. 10 is a drawing showing the relationship of experimental values between an air flow rate flowing out of the indoor unit 8 and the angle 4 when the angle 4 is changed while the revolving speed of the cross-flow fan 1 is 1500 rpm; and FIG. 11 is a drawing showing the relationship of experimental values between an input power of the fan motor and the angle 4 when the flow rate flowing out of the indoor unit 8 is 16 $m^3$/min. The cross-flow fan 1 used in the experiments shown in FIGS. 10 and 11 has an external diameter of the blade 13 of 100ϕ; an outlet angle 20 of 26°; an inlet angle 21 of 94°; a chord length 23 of 12.4 mm; and a maximum warp 25 of 2.5 mm.

The experiments were made under conditions that the numbers of stages of the front heat exchanger 2 and the back heat exchanger 3 are 4 and 6, respectively, and the numbers of rows thereof are 2; the row pitch of the refrigerant piping 32 is 12.7 mm and the stage pitch thereof is 20.4 mm; the height of the indoor unit 8 is 305 mm; the shortest distance between the blade 13 and the front heat exchanger 2 is 15 mm; and the angle 4 is 60 to 90°. In FIG. 10, when the angle 4 at 1500 rpm is 60°, the air flow rate is set to be 100. In FIG. 10, when the angle 4 at 1500 rpm is 60°, the input power of the fan is set to be 100.

As shown in FIG. 10, with increasing angle 4, the flow rate at 1500 rpm increases, and as shown in FIG. 11, with increasing angle 4, the input power of the fan at the flow rate 16 $m^3$/min reduces. In a cooling period, moisture is condensed when the air 9 is passing through the front heat exchanger 2 and the auxiliary heat exchanger 43 so as to be liable to generate water droplets; when the angle 4 is smaller than 65°, a problem arises in that part of the water droplets flows into the cross-flow fan 1 so as to blow out outside the indoor unit 8 or to stick on a wall of the air outlet 7. When the angle 4 is larger than 90°, the distance between the front heat exchanger 2 and the auxiliary heat exchanger 43 becomes short in the vicinity of a junction therebetween, so that an air resistance is produced before the wind. There is also a problem that the depth of the unit increases.

As described above, when the angle 4 of the front heat exchanger 2 is not 65 to 90° and the point A of the back heat exchanger 3 closest to the front heat exchanger 2 is not located adjacent to the back heat exchanger 3 from the rotational center O of the cross-flow fan 1, there has been a problem that the input power and the revolution speed of a fan motor required for obtaining a predetermined airflow are large. Whereas, when the angle 4 of the front heat exchanger 2 is 65 to 90° and the point A of the back heat exchanger 3 closest to the front heat exchanger 2 is located adjacent to the front heat exchanger 2 from the rotational center O of the cross-flow fan 1, the input power the fan motor required for obtaining a predetermined airflow can be reduced.

According to the embodiment, as shown in FIG. 6, the point F and the point G of the front heat exchanger 2 are positioned on a straight line; alternatively, the point F and the point G may not be positioned on the straight line. In this case, when the line FG is curved, the angle 4 is the maximum value of the angle defined by a line tangent to the curved line FG and the horizontal line.

Second Embodiment

In a second embodiment, a range of the outlet angle 20 of the blade 13 of the cross-flow fan 1 capable of reducing the input power of the fan motor necessary for obtaining a predetermined airflow is determined by experiments.

Figure 12:
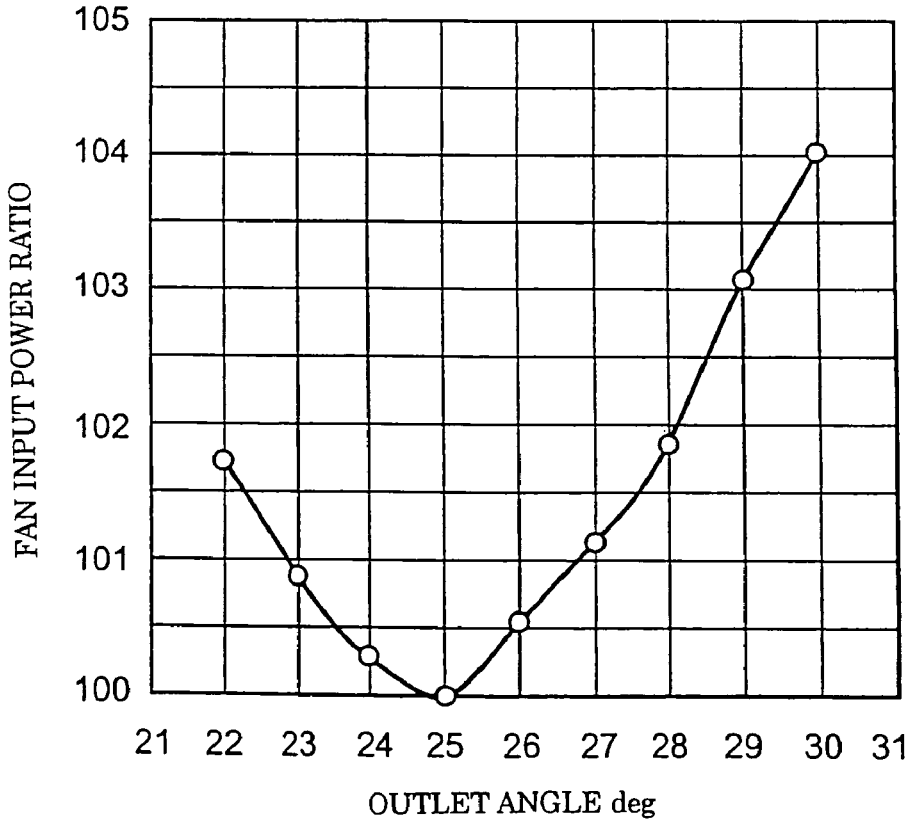
FIG. 12 is a drawing of the structure of a second embodiment according to the present invention showing the relationship between an input power of the fan motor and an outlet angle.
Figure 13:
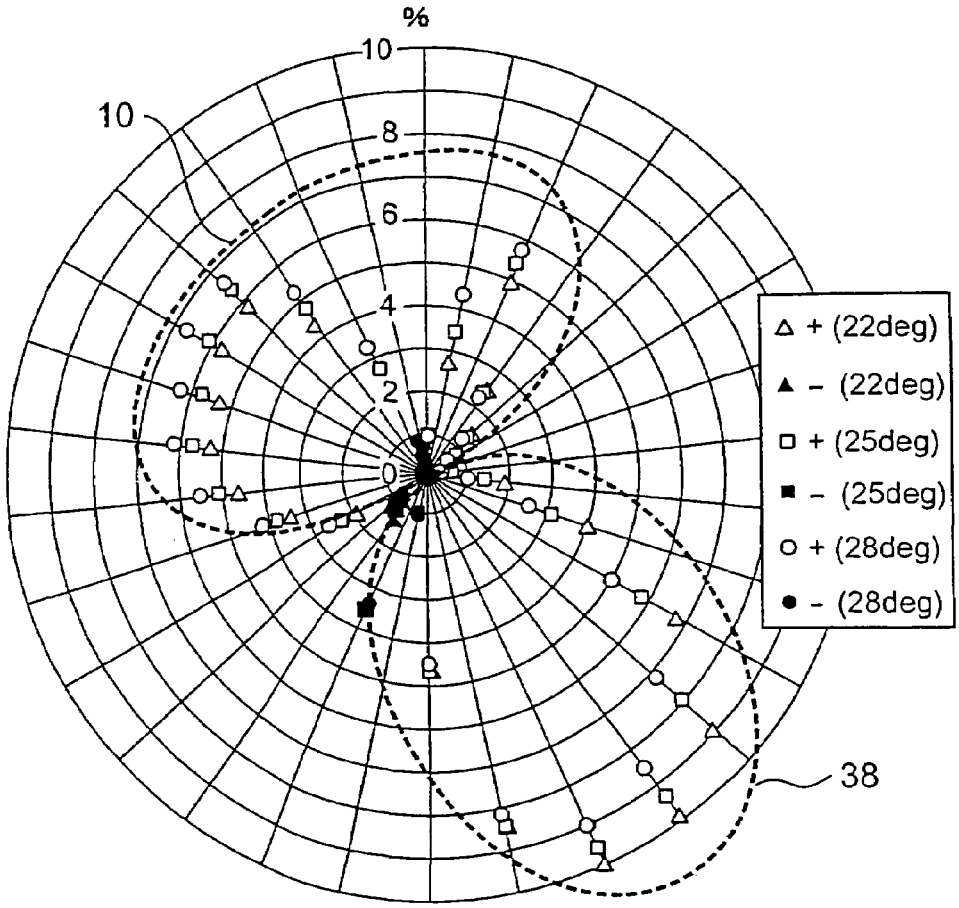
FIG. 13 is a torque distribution drawing of the cross-flow fan showing the structure of the second embodiment according to the present invention.

FIG. 12 is a drawing of the structure of the second embodiment according to the present invention showing the relationship between the input power of the fan motor and the outlet angle; FIG. 13 is a drawing of the structure of the second embodiment according to the present invention showing the torque distribution of the cross-flow fan. The structure of an air conditioner is the same as that according to the first embodiment shown in FIG. 6 in which the range of the outlet angle 20 shown in FIG. 4 according to the first embodiment is determined, and the description the structure is omitted.

The cross-flow fan 1 used in the experiments had an external diameter of the blade 13 of 100ϕ; an inlet angle 21 of 94°; a chord length 23 of 12.4 mm; and a maximum warp 25 of 2.5 mm; the angle 4 shown in FIG. 6 was 73.6°; and the angle 28 was 17.6°. The numbers of stages of the front heat exchanger 2 and the back heat exchanger 3 were 4 and 6, respectively, and the numbers of rows thereof were 2; the row pitch of the refrigerant piping 32 was 12.7 mm and the stage pitch thereof was 20.4 mm; and the height of the indoor unit 8 was 305 mm.

Then, the outlet angle 20 of the blade 13 of the cross-flow fan 1 was changed in the range of 22 to 30°, and the input power of the fan motor necessary for obtaining a flow rate of 16 $m^3$/min was investigated.

The experimental results are shown in FIG. 12. In FIG. 12, when the outlet angle 20 is 25° and the air flow rate flowing out of the indoor unit 8 is 16 $m^3$/min, the input power of the fan motor is set to be 100.

As shown in FIG. 12, when the outlet angle 20 is 25°, the input power of the fan motor is minimal.

Then, the reason thereof will be described with reference to FIGS. 6, 12, and 13. FIG. 13 is a drawing showing a percentage of torque distribution of each blade 13 of the cross-flow fan 1 when the outlet angle 20 is 22°, 25°, and 28°. The meaning of the plot position and the value in FIG. 13 is a torque percentage at each position of the blade 13 in FIG. 6, and the torque percentage means the torque of the blade 13 at each position divided by the total sum of the torques of the entire blade 13. The meanings of terms in FIG. 13, such as +(22 deg) and −(22 deg), are that "+" is a region increasing the input power of the fan motor and "−" is a region reducing the input power of the fan motor. The "−" region reducing the input power of the fan motor is a region where the static pressure in the pressure surface 15 is smaller than the static pressure in the suction surface 14 because the attack angle 12 is excessively small and the separation generates in the pressure surface 15.

In FIG. 13, with increasing outlet angle 20, a torque percentage of a fan delivery region 38 is reduced while a torque percentage of the fan suction region 10 is increased. This is because while an area between blades 13 effective to the air flow rate is increased, the attack angle 12 is large in the fan suction region 10 so that separation is liable to generate in the suction surface 14.

In contrast, with decreasing outlet angle 20, a torque percentage of the fan suction region 10 is reduced while a torque percentage of the fan delivery region 38 is increased. This is because while the attack angle 12 (see FIG. 3) is small in the fan suction region 10 so that separation is difficult to generate in the suction surface 14, an area between blades 13 effective to the air flow rate is reduced in the fan delivery region 38.

In FIG. 12, when the outlet angle 20 is 25°, the input power of the fan motor is minimal. As described above, there are an advantage and a disadvantage when the outlet angle 20 is larger as well as smaller, and in view of both the advantage and the disadvantage, the input power of the fan motor is optimal when the outlet angle 20 is 25°.

In the above-description, the outlet angle has been described when the angle 4 is 73.6°. With increasing angle 4, the outlet angle 20 minimizing the input power of the fan motor is increased while with decreasing angle 4, the outlet angle 20 minimizing the input power of the fan motor is reduced. Although details are omitted, when the angle 4 is 90°, the outlet angle 20 minimizing the input power of the fan motor was 28° while when 65°, the outlet angle 20 minimizing the input power of the fan motor was 22°.

As described above, there has been a problem that the input power of the fan motor necessary for obtaining a predetermined flow rate is large when the angle 4 of the front heat exchanger 2 is not 65 to 90°; a point A of the back heat exchanger 3 closest to the front heat exchanger 2 is positioned adjacent to the back heat exchanger 3 from the rotational center O of the cross-flow fan 1; and the outlet angle 20 of the blade 13 of the cross-flow fan 1 is not 22 to 28°. Whereas the input power of the fan motor necessary for obtaining a predetermined flow rate can be reduced under conditions that the angle 4 of the front heat exchanger 2 is 65 to 90°; a point A of the back heat exchanger 3 closest to the front heat exchanger 2 is positioned adjacent to the front heat exchanger 2 from the rotational center O of the cross-flow fan 1; and the outlet angle 20 of the blade 13 of the cross-flow fan 1 is 22 to 28°.

Third Embodiment

In a third embodiment, a range of the inlet angle 21 of the blade 13 of the cross-flow fan 1 capable of increasing the flow rate when the fan motor is rotated at a predetermined rotational speed is determined by experiments.

Figure 14:
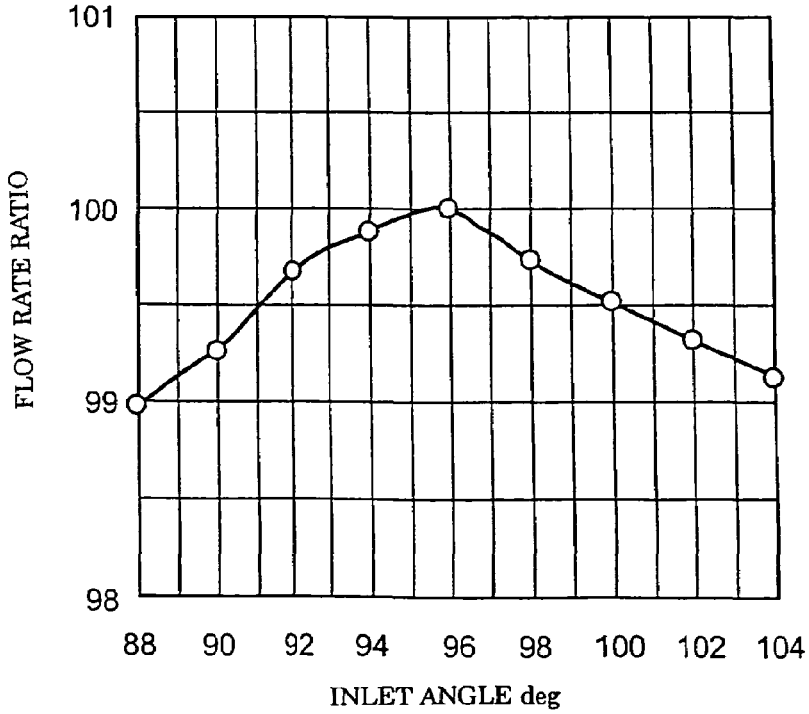
FIG. 14 is a drawing of the structure of a third embodiment according to the present invention showing the relationship between an input power of the fan motor and an inlet angle.
Figure 15:
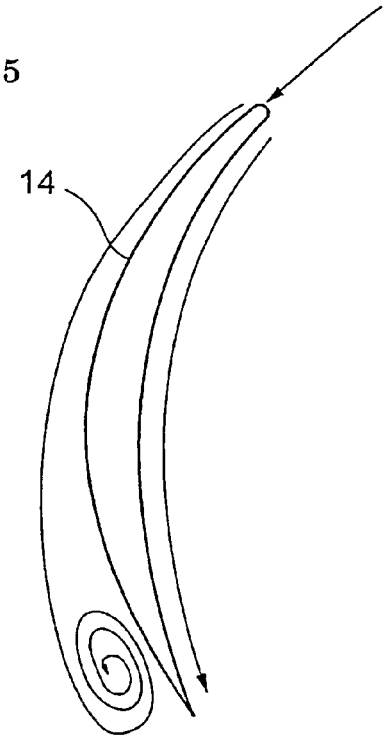
FIG. 15 is a drawing of the structure of the third embodiment according to the present invention showing separation on a suction surface in the suction region of the cross-flow fan.
Figure 16:
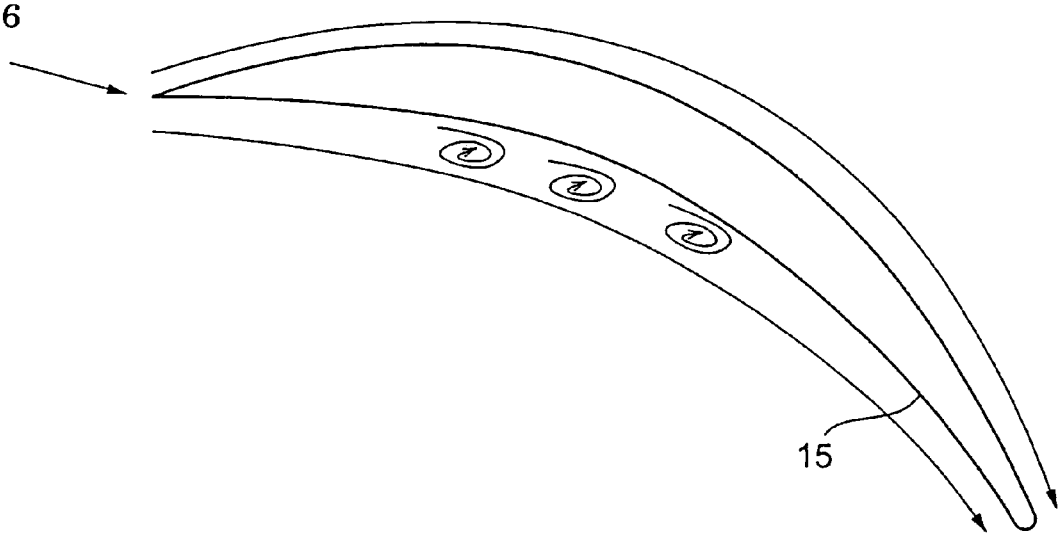
FIG. 16 is a drawing of the structure of the third embodiment according to the present invention showing the separation on a pressure surface in the delivery region of the cross-flow fan.
Figure 17:
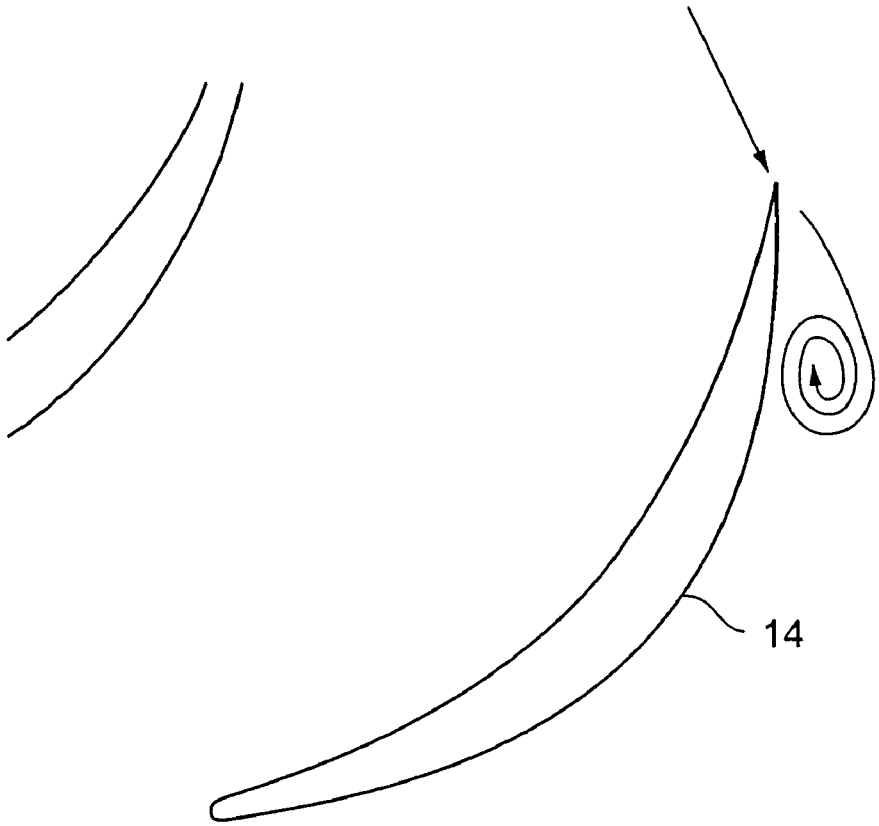
FIG. 17 is a drawing of the structure of the third embodiment according to the present invention showing the separation on a suction surface in the vicinity of a stabilizer.

FIG. 14 is a drawing of the structure of the third embodiment according to the present invention showing the relationship between the input power of the fan motor and the inlet angle; FIG. 15 is a drawing of the structure of the third embodiment according to the present invention showing the separation of the suction surface 14 in the suction region of the cross-flow fan; FIG. 16 is a drawing of the structure of the third embodiment according to the present invention showing the separation of the pressure surface in the delivery region of the cross-flow fan; and FIG. 17 is a drawing of the structure of the third embodiment according to the present invention showing the separation of the suction surface 14 in the vicinity of a stabilizer.

The structure of an air conditioner is the same as that according to the first embodiment shown in FIG. 6 in which the range of the inlet angle 21 shown in FIG. 4 according to the first embodiment is determined, and the description the structure is omitted.

The cross-flow fan 1 used in the experiments had an external diameter of the blade 13 of 100ϕ; an outlet angle 20 of 25°; a chord length 23 of 12.4 mm; and a maximum warp 25 of 2.5 mm; the angle 4 shown in FIG. 6 was 73.6°; and the angle 28 was 17.6°. The numbers of stages of the front heat exchanger 2 and the back heat exchanger 3 were 4 and 6, respectively, and the numbers of rows thereof were 2; the row pitch of the refrigerant piping 32 was 12.7 mm and the stage pitch thereof was 20.4 mm; and the height of the indoor unit 8 was 305 mm.

Then, the inlet angle 21 of the blade 13 of the cross-flow fan 1 was changed in the range of 88 to 104°, and the flow rate flowing out to the indoor unit 8 while the revolving speed of the cross-flow fan 1 was 1500 rpm was investigated.

The experimental results are shown in FIG. 14. In FIG. 14, when the inlet angle 21 is 96° and the revolving speed of the cross-flow fan 1 is 1500 rpm, the flow rate flowing out to the indoor unit 8 is set to be 100. As shown in FIG. 14, when the inlet angle 21 is 96°, the flow rate is maximal.

Then, the reason thereof will be described with reference to FIGS. 6, and 14 to 17. FIG. 15 is a drawing of relative speed distribution showing an example of the separation generated on the suction surface 14 in the fan suction region 10; FIG. 16 is a drawing of relative speed distribution showing an example of the separation generated on the pressure surface 15 in the fan delivery region 38; and FIG. 17 is a drawing of relative speed distribution showing an example of the separation generated on the suction surface 14 in the vicinity of a stabilizer 39 shown in FIG. 1.

If the inlet angle 21 is small, in the fan suction region 10, the suction surface 14 is difficult to be separated, and while the attack angle 12 (see FIG. 3) is not excessively reduced in the fan delivery region 38 so that separation is difficult to generate in the pressure surface 15, as shown in FIG. 17, there is a problem that the suction surface 14 is liable to be separated in a region 40 in the vicinity of the stabilizer 39. In contrast, if the inlet angle 21 is large, while the suction surface 14 is difficult to be separated in the region 40 in the vicinity of the stabilizer 39, as shown in FIG. 15, in the fan suction region 10, the suction surface 14 is liable to be separated, so that as shown in FIG. 16, there is a problem in that the attack angle 12 is excessively reduced in the fan delivery region 38, so that the separation is liable to generate on the pressure surface 15.

In FIG. 14, when the inlet angle 21 is 96°, the flow rate at 1500 rpm is maximal. As described above, there are an advantage and a disadvantage when the inlet angle 21 is larger as well as smaller, and in view of both the advantage and the disadvantage, the flow rate is optimal when the inlet angle 21 is 96°.

The flow rate is maximal when the inlet angle 21 is 96°, so that flow rate ratio at this time is set to 100. The allowable range is set to be 0.5% of the maximum flow rate ratio, i.e., from 99.5 to 100%, so that the range of the inlet angle 21 of from 91 to 100° corresponding thereto is preferable.

As described above, there has been a problem that the flow rate at a predetermined rotational speed is small when the angle 4 of the front heat exchanger 2 is not 65 to 90°; a point A of the back heat exchanger 3 closest to the front heat exchanger 2 is positioned adjacent to the back heat exchanger 3 from the rotational center O of the cross-flow fan 1; and the inlet angle 21 of the blade 13 of the cross-flow fan 1 is not 91 to 100°. Whereas the flow rate at a predetermined rotational speed can be increased when the angle 4 of the front heat exchanger 2 is 65 to 90°; a point A of the back heat exchanger 3 closest to the front heat exchanger 2 is positioned adjacent to the front heat exchanger 2 from the rotational center O of the cross-flow fan 1; and the inlet angle 21 of the blade 13 of the cross-flow fan 1 is 91 to 100°.

Fourth Embodiment

In a fourth embodiment, a range of hc/D of the blade 13 of the cross-flow fan 1 capable of reducing the input power necessary for obtaining a predetermined flow rate is determined by experiments where character hc denotes a maximum warp of the blade 13 of the cross-flow fan 1 and character D denotes an external diameter of the blade 13.

Figure 18:
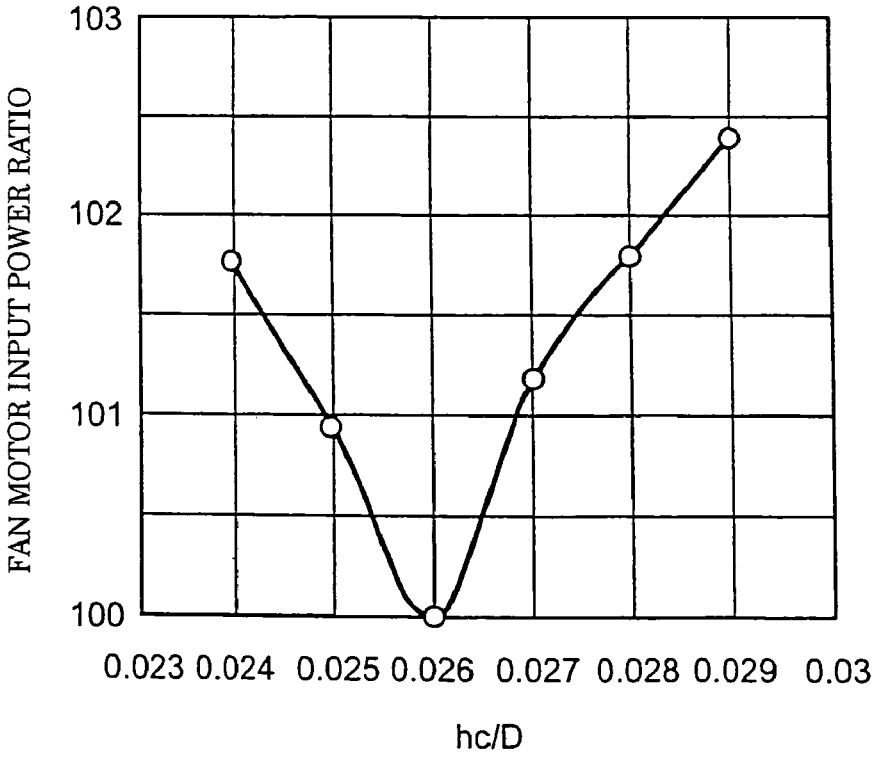
FIG. 18 is a drawing of the structure of a fourth embodiment according to the present invention showing an input power of the fan motor.
Figure 19:
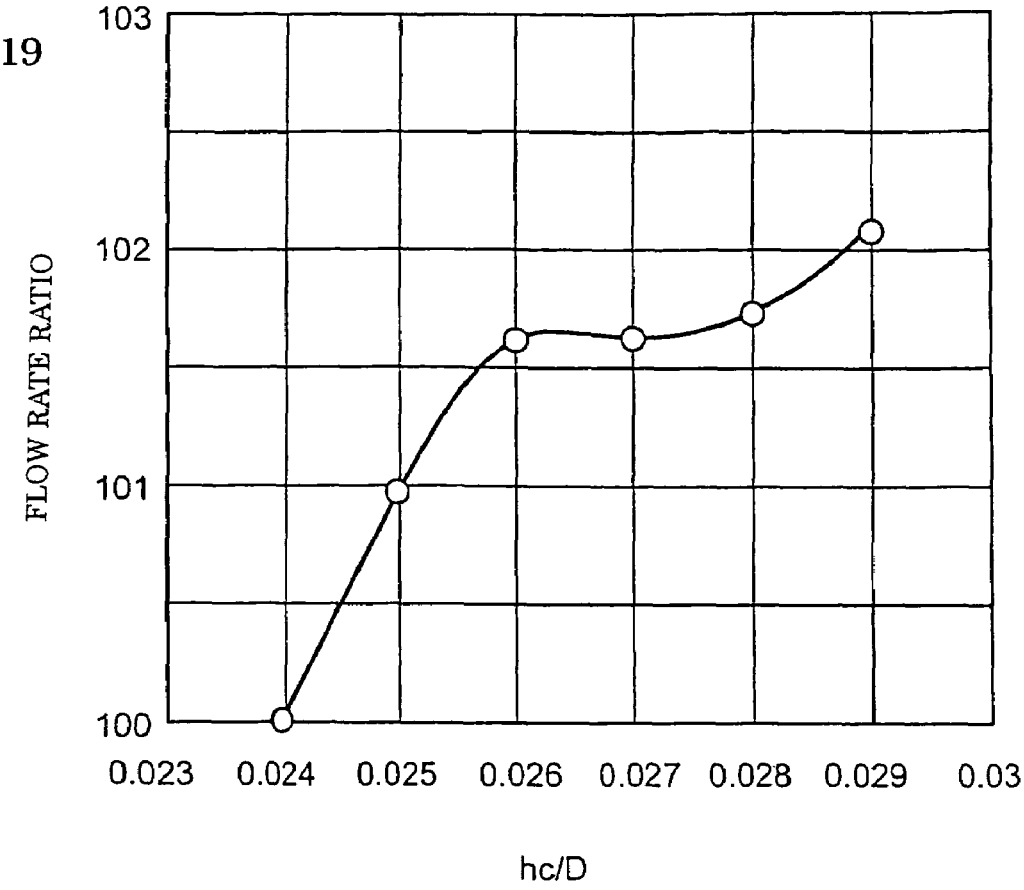
FIG. 19 is a drawing of the structure of the fourth embodiment according to the present invention showing an airflow rate.
Figure 20:
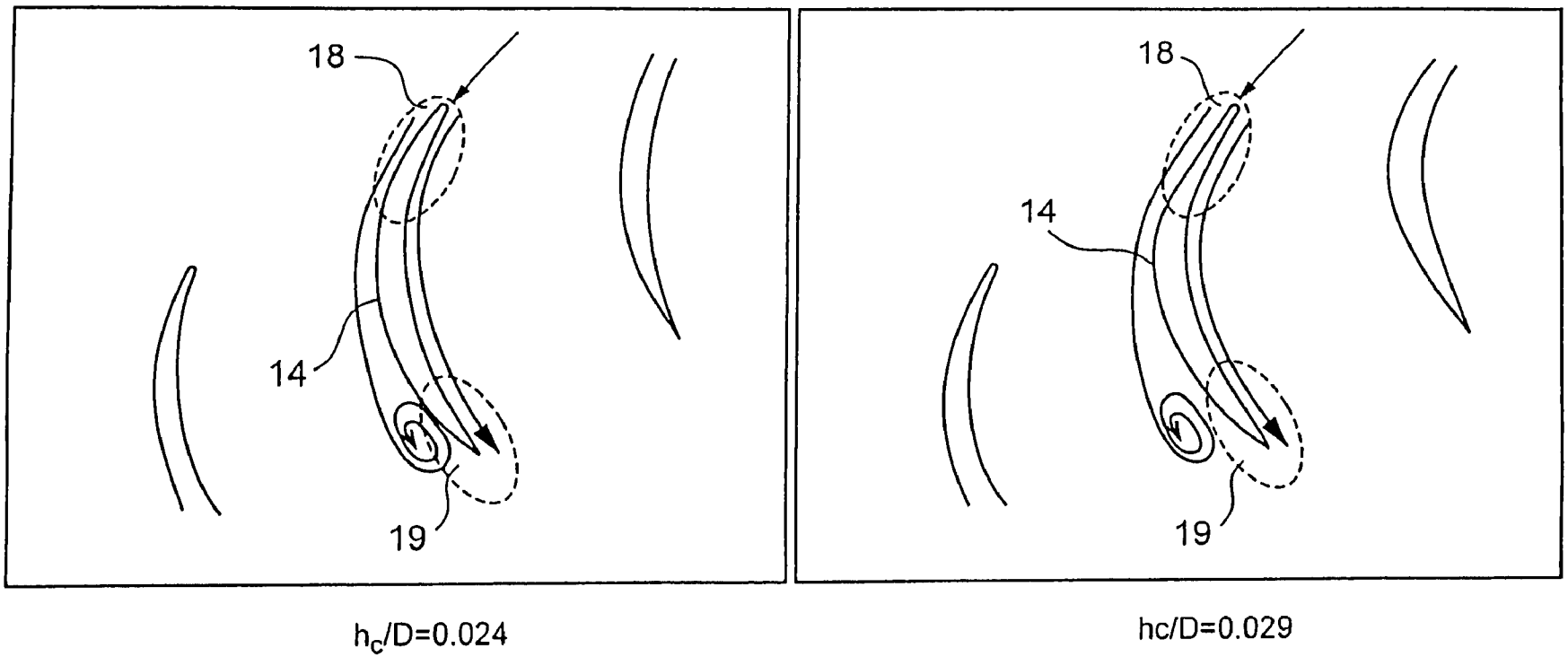
FIG. 20 is a drawing of the structure of the fourth embodiment according to the present invention showing the separation on a suction surface in the suction region of the cross-flow fan.

FIG. 18 is a drawing showing the relationship of experimental results between the input power of the fan motor when the flow rate flowing out of the indoor unit 8 is 16 $m^3$/min and hc/D when hc/D of the blade 13 of an air conditioner according to the fourth embodiment of the present invention is changed; FIG. 19 is a drawing showing the relationship of experimental results between the flow rate of the air conditioner according to the fourth embodiment of the present invention at 1500 rpm and hc/D; and FIG. 20 is a drawing of the structure of the fourth embodiment according to the present invention showing the separation on the suction surface in the fan suction region.

The structure of an air conditioner is the same as that according to the first embodiment shown in FIG. 6 in which the range of hc/D shown in FIG. 4 according to the first embodiment is determined, and the description the structure is omitted.

The cross-flow fan 1 used in the experiments had an external diameter of the blade 13 of 100ϕ; an outlet angle 20 of 25°; an inlet angle 21 of 96°; a chord length 23 of 12.4 mm; and a maximum blade thickness 41 of 1.07 mm; the angle 4 shown in FIG. 6 was 73.6°; and the angle 28 was 17.6°. The numbers of stages of the front heat exchanger 2 and the back heat exchanger 3 were 4 and 6, respectively, and the numbers of rows thereof were 2; the pitch of the refrigerant piping 32 was 10.2 mm; and the height of the indoor unit 8 was 305 mm.

Then, hc/D was changed in the range of 0.024 to 0.029, and the input power of the fan motor necessary for obtaining the flow rate flowing out of the indoor unit 8 of 16 $m^3$/min was investigated, where character hc denotes a maximum warp of the blade 13 and character D denotes an external diameter of the blade 13.

The experimental results are shown in FIG. 18. In FIG. 18, when hc/D is 0.026 and the flow rate flowing out of the indoor unit 8 is 16 $m^3$/min, the input power of the fan motor is set to be 100. Also, in FIG. 19, when hc/D is 0.024 at 1500 rpm, the flow rate is set to be 100.

As shown in FIG. 18, when hc/D is 0.026, the input power of the fan motor necessary for obtaining a flow rate flowing out of the indoor unit 8 of 16 $m^3$/min is minimal. As shown in FIG. 19, with increasing hc/D, the flow rate at 1500 rpm is increased.

Then, the reason thereof will be described with reference to FIGS. 18 to 20. FIG. 20 is a drawing showing the separation on the suction surface 14 in the fan suction region 10.

As shown in FIG. 20, if hc/D is large, the separation is liable to generate at the leading edge 18 of the suction surface 14, while when hc/D is small, although the separation is difficult to generate at the leading edge 18 of the suction surface 14, the separation is liable to generate at the trailing edge 19 of the suction surface 14. Hence, as shown in FIG. 18, the input power of the fan motor is minimal when hc/D is 0.026.

Also, with increasing hc/D, the warp is increased so as to have a high lift. Thus, as shown in FIG. 19, the flow rate at a predetermined rotational speed is increased.

In the above-description, hc/D has been described when the angle 4 is 73.6°. When the angle 4 is 90°, hc/D minimizing the input power of the fan motor has been 0.025 while when the angle 4 is 65°, hc/D minimizing the input power of the fan motor has been 0.028.

Hence, when hc/D is in the range of 0.025 to 0.028, the input power of the fan motor necessary for obtaining a predetermined flow rate is reduced, so that the flow rate at a predetermined rotational speed can be increased.

As described above, there has been a problem that the input power of the fan motor necessary for obtaining a predetermined flow rate is large when the angle 4 of the front heat exchanger 2 is not 65 to 90°; a point A of the back heat exchanger 3 closest to the front heat exchanger 2 is positioned adjacent to the back heat exchanger 3 from the rotational center O of the cross-flow fan 1; and hc/D is not in the range of 0.025 to 0.028, where character D denotes an external diameter of the blade 13 of the cross-flow fan 1 and character hc denotes a maximum blade thickness 41. Whereas the input power of the fan motor necessary for obtaining a predetermined flow rate can be reduced when the angle 4 of the front heat exchanger 2 is 65 to 90°; a point A of the back heat exchanger 3 closest to the front heat exchanger 2 is positioned adjacent to the front heat exchanger 2 from the rotational center O of the cross-flow fan 1; and hc/D is in the range of 0.025 to 0.028, where character D denotes an external diameter of the blade 13 of the cross-flow fan 1 and character hc denotes a maximum blade thickness 41.

Fifth Embodiment

In a fifth embodiment, in order to reduce the input power of the fan motor necessary for obtaining a predetermined flow rate, variations of pressure loss due to an airflow resistor in the side of the front heat exchanger 2 and an airflow resistor in the side of the back heat exchanger 3 are determined by experiments.

The structure of an air conditioner is the same as that according to the first embodiment shown in FIG. 9, so that the description thereof is omitted.

In the experiments, as shown in FIG. 9, the airflow resistor in the side of the front heat exchanger 2 is to be the auxiliary heat exchanger 43 while the airflow resistor in the side of the back heat exchanger 3 is to be an auxiliary heat exchanger 44. As shown in Table 1, in case A, the respective draft resistances of the auxiliary heat exchanger 43 and the auxiliary heat exchanger 44 are 1; in case B, the draft resistance of the auxiliary heat exchanger 43 is 2 (twice the draft resistance of the auxiliary heat exchanger 43 in case A) and the draft resistance of the auxiliary heat exchanger 44 is 1 (the same as the draft resistance of the auxiliary heat exchanger 44 in case A); and in case C, the draft resistance of the auxiliary heat exchanger 43 is 1 and the draft resistance of the auxiliary heat exchanger 44 is 2. Under these conditions, when the flow rate flowing out of the indoor unit 8 is 16 $m^3$/min, the input power of the fan motor is investigated.

TABLE 1

| | The draft resistance of the auxiliary heat exchanger and the input power of the fan motor | | |
|---|---|---|---|
| | draft resistance of auxiliary heat exchanger | | |
| case | the auxiliary heat exchanger 43 | the auxiliary heat exchanger 44 | fan motor input power (at flow rate 86 $m^3$/min) |
| A | 1 | 1 | 100 |
| B | 2 | 1 | 106.4 |
| C | 1 | 2 | 104.6 |

The experimental results are shown in Table 1. In case A, when the respective draft resistances of the auxiliary heat exchanger 43 and the auxiliary heat exchanger 44 are 1, the input power of the fan motor is set to be 100 when the flow rate is 16 $m^3$/min.

The input power of the fan motor is minimal in case A; is 106.4 in case B which is maximal; is 104.6 in case C which is intermediate. From these results, in order to reduce the input power of the fan motor, it is most preferable that the draft resistance of the auxiliary heat exchanger 43 be the same as that of the auxiliary heat exchanger 44, and it is preferable that the draft resistance of the auxiliary heat exchanger 43 be smaller than that of the auxiliary heat exchanger 44.

That is, in order to reduce the input power of the fan motor, it is most preferable that the draft resistance of the auxiliary heat exchanger 43 be the same as that of the auxiliary heat exchanger 44, and it is preferable that the draft resistance of the auxiliary heat exchanger 43 be smaller than that of the auxiliary heat exchanger 44.

The reasons thereof will be described with reference to FIG. 9. From the vector drawing of FIG. 9, with increasing velocity vector 36 and with decreasing angle 37, in the fan suction region 10, the attack angle 16 can be reduced, so that the separation in the suction surface 14 can be suppressed. In order to increase the velocity vector 36 and to reduce the angle 37, it is preferable that the velocity vector 34 be increased and the direction of the vector be inclined toward the horizon; the velocity vector 35 be reduced and the vector be inclined toward the verticality. The results of Table 1 represent that with increasing velocity vector 36 and with decreasing angle 37, the input power of the fan motor is smaller.

According to the embodiment, as the resistors before the wind of the front heat exchanger 2 and the back heat exchanger 3, the auxiliary heat exchangers 43 and 44 are used; alternatively, a draft resistor, such as an electric precipitator, may also be used. However, the air-cleaning filter 5 cannot be included in the draft resistor. The definition of the pressure loss of the draft resistor on the side of the front heat exchanger 2 and the pressure loss of the draft resistor on the side of the back heat exchanger 3 is the static pressure difference between upwind and down wind when each resistor is placed in a wind tunnel and air is run through at the same flow rate in a direction perpendicular to the front heat exchanger 2 and the back heat exchanger 3. In addition, the pressure loss of the draft resistor on the side of the front heat exchanger 2 and the pressure loss of the draft resistor on the side of the back heat exchanger 3 can be adjusted with fin pitches of the front heat exchanger 2 and the back heat exchanger 3, the pipe pitch of the refrigerant piping 32, and the shape of the slit 46.

As described above, there has been a problem that when the pressure loss of the draft resistor on the side of the front heat exchanger 2 is larger than the pressure loss of the draft resistor on the side of the back heat exchanger 3, the input power of the fan motor necessary for obtaining a predetermined flow rate is large. Whereas, by reducing the pressure loss of the draft resistor on the side of the front heat exchanger smaller than the pressure loss of the draft resistor on the side of the back heat exchanger 3, airflow from the front heat exchanger toward the cross-flow fan 1 is generated, so that the attack angle of the blade 13 in the suction region of the cross-flow fan 1 can be reduced. Thereby, the airflow is difficult to stall in the suction surface 14 so that the input power of the fan motor necessary for obtaining a predetermined flow rate can be reduced.

Sixth Embodiment

Figure 21:
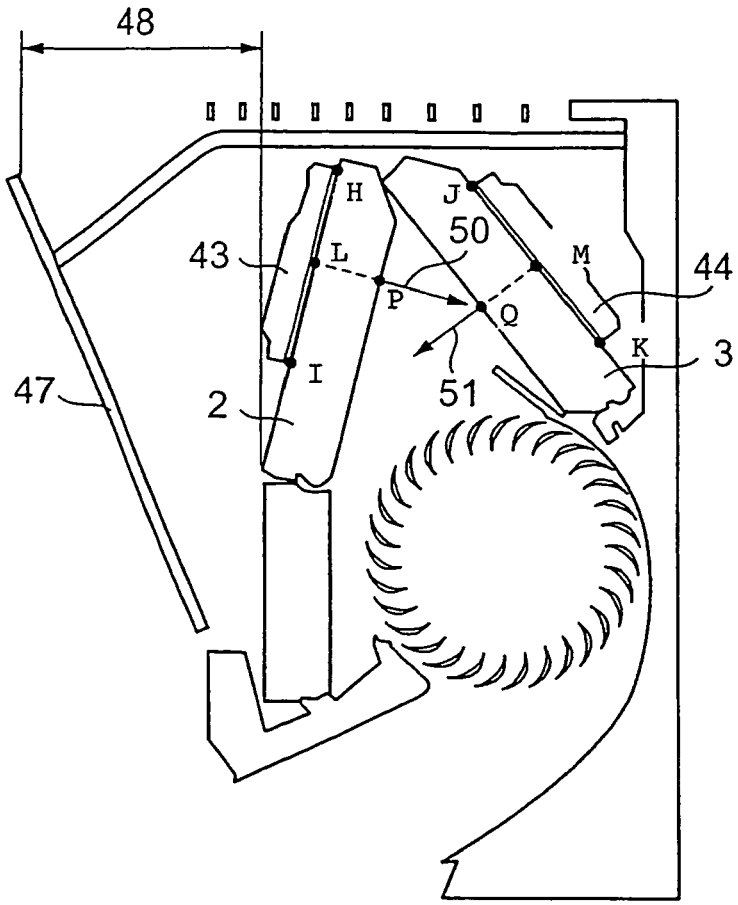
FIG. 21 is a drawing of the structure of a sixth embodiment according to the present invention showing a section of an indoor unit.
Figure 22:
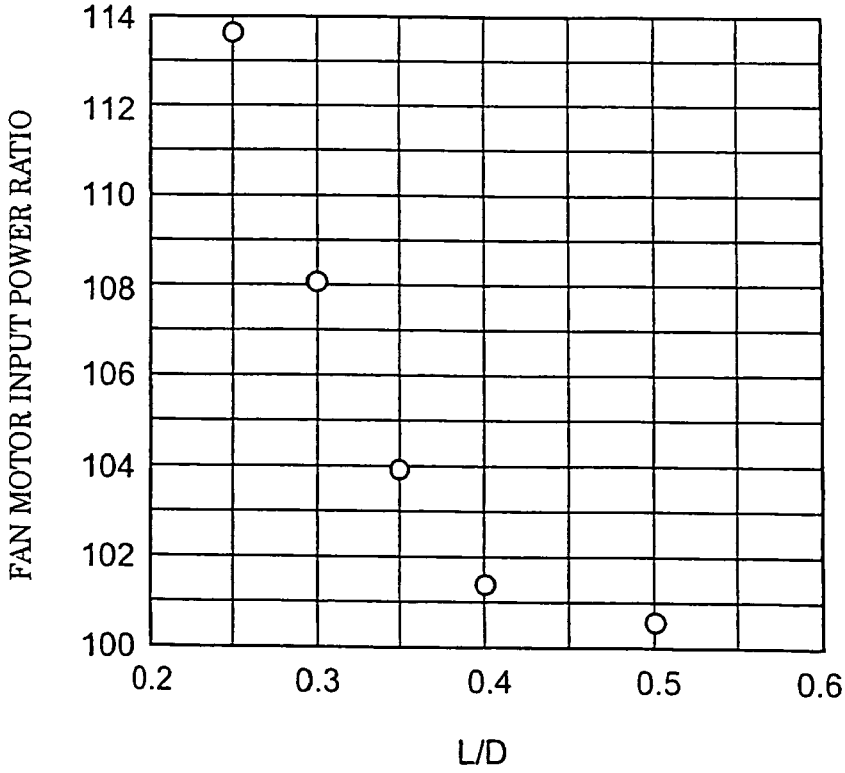
FIG. 22 is a drawing of the structure of the sixth embodiment according to the present invention showing an input power of the fan motor.

FIG. 21 is a sectional view of an indoor unit of an air conditioner according to a sixth embodiment; FIG. 22 is a drawing showing the relationship of experimental results between the input power of the fan motor and L/D when L/D is changed and the flow rate flowing out of the indoor unit 8 is 16 $m^3$/min, where character D denotes an external diameter of the blade 13 of the cross-flow fan 1 and character L denotes a distance 48. The distance 48 denotes a horizontal distance between a point of the head of a suction panel 47 adjacent to the front heat exchanger 2 and a point of the front heat exchanger 2 closest to the suction panel 47. Also, in FIG. 22, when L/D=0.6, the input power of the fan motor is set to be 100.

Figure 23:
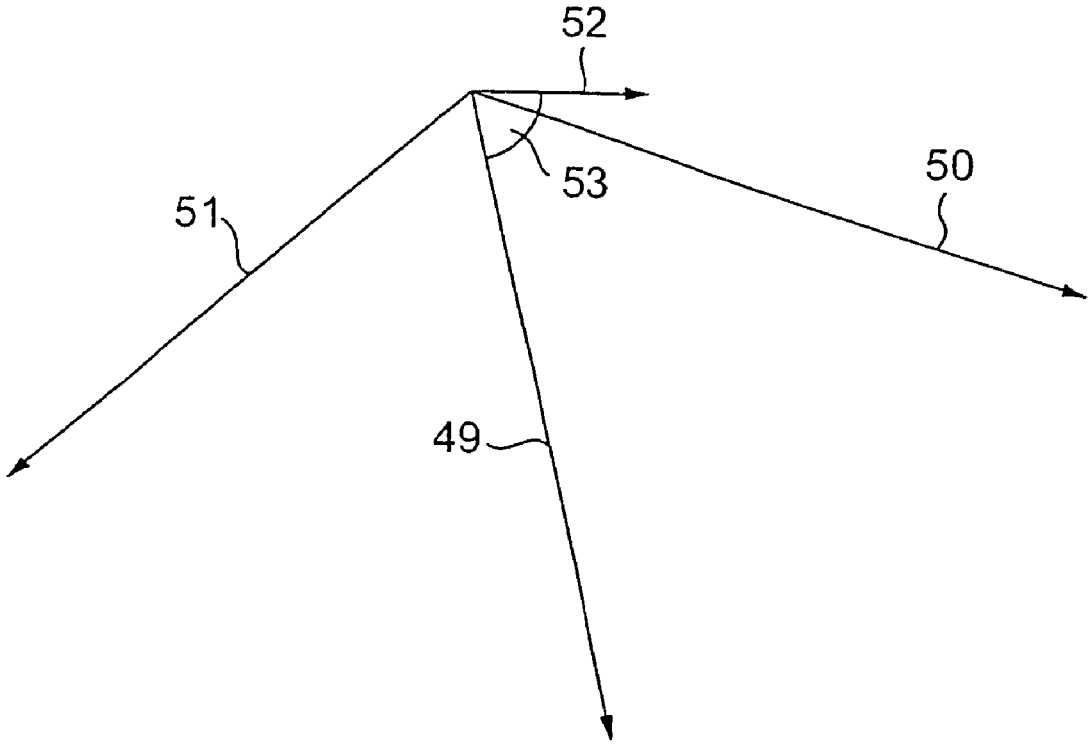
FIG. 23 is a drawing of the structure of the sixth embodiment according to the present invention showing a velocity vector.

FIG. 23 is a drawing showing a velocity vector sum of a velocity. The velocity vector sum 49 shown in FIG. 23 is a vector sum of a velocity vector 50 at the point P of intersection of a straight line passing the midpoint L of points H and I of the auxiliary heat exchanger 43 perpendicularly to the front heat exchanger 2 and a velocity vector 51 at the point Q of intersection of a straight line passing the midpoint M of points J and K of the auxiliary heat exchanger 44 perpendicularly to the back heat exchanger 3.

As shown in FIG. 22, with increasing L/D, the input power of the fan motor necessary for obtaining a predetermined flow rate is reduced; however, if L/D≧0.4, the input power of the fan motor hardly varies.

Then, the reasons thereof will be described. Since with increasing distance 48, the velocity vector sum 49 is increased, a horizontal vector component 52 of the velocity vector sum 49 is increased so that an angle 53 is reduced. The reason is that since the attack angle 12 in the suction region 10 of the cross-flow fan 11 is reduced, airflow is difficult to stall in the suction surface 14. If air does not pass thorough the suction panel 47 and the distance 48 is small, air is difficult to flow through the upper portion of the front heat exchanger 2 because the draft resistance is small in bottom portions of the back heat exchanger 3 and the front heat exchanger 2.

As described above, there has been a problem that the input power of the fan motor necessary for obtaining a predetermined flow rate is large when L/D<0.4. Whereas, by rendering the ratio L/D≧0.4, the attack angle 12 in the suction region 10 of the cross-flow fan 1 can be reduced so that the input power of the fan motor necessary for obtaining a predetermined flow rate can be reduced.

The invention claimed is:

1. An air conditioner comprising:

an indoor unit having at least one inlet and one outlet;

a cross-flow fan connected to a fan motor;

a front heat exchanger; and a back heat exchanger, wherein an installation angle α of the front heat exchanger positioned above the rotational center of the cross-flow fan relative to the horizon is 65°≦α≦90°, a point of the back heat exchanger closest to the front heat exchanger is located adjacent to the front heat exchanger from the rotational center of the cross-flow fan, and an outlet angle β2 of a blade of the cross-flow fan is 22°≦β2≦28°.

2. The air conditioner according to claim 1, further comprising at least one kind or more of draft resistors arranged on the upwind side of the front heat exchanger and on the upwind side of the back heat exchanger, wherein a draft resistance of the draft resistor on the side of the front heat exchanger is identical to or smaller than a draft resistance of the draft resistor on the side of the back heat exchanger.

3. The air conditioner according to claim 1, wherein the ratio is L/D≧0.4, where the external diameter of the blade of the cross-flow fan is D and the maximum distance between a suction panel and the front heat exchanger is L.

4. An air conditioner comprising:

an indoor unit having at least one inlet and one outlet;

a cross-flow fan connected to a fan motor;

a front heat exchanger; and a back heat exchanger, wherein an installation angle α of the front heat exchanger positioned above the rotational center of the cross-flow fan relative to the horizon is 65°≦α≦90°, a point of the back heat exchanger closest to the front heat exchanger is located adjacent to the front heat exchanger from the rotational center of the cross-flow fan, and an inlet angle β1 of a blade of the cross-flow fan is 91°≦β1≦100°.

5. The air conditioner according to claim 4, further comprising at least one kind or more of draft resistors arranged on the upwind side of the front heat exchanger and on the upwind side of the back heat exchanger, wherein a draft resistance of the draft resistor on the side of the front heat exchanger is identical to or smaller than a draft resistance of the draft resistor on the side of the back heat exchanger.

6. The air conditioner according to claim 4, wherein the ratio is L/D≧0.4, where the external diameter of the blade of the cross-flow fan is D and the maximum distance between a suction panel and the front heat exchanger is L.

7. An air conditioner comprising:

an indoor unit having at least one inlet and one outlet;

a cross-flow fan connected to a fan motor;

a front heat exchanger; and a back heat exchanger, wherein an installation angle α of the front heat exchanger positioned above the rotational center of the cross-flow fan relative to the horizon is 65°≦α≦90°, a point of the back heat exchanger closest to the front heat exchanger is located adjacent to the front heat exchanger from the rotational center of the cross-flow fan, and when the external diameter of a blade of the cross-flow fan is D and a maximum warp is hc, hc/D is 0.025≦hc/D≦0.028.

8. The air conditioner according to claim 7, further comprising at least one kind or more of draft resistors arranged on the upwind side of the front heat exchanger and on the upwind side of the back heat exchanger, wherein a draft resistance of the draft resistor on the side of the front heat exchanger is identical to or smaller than a draft resistance of the draft resistor on the side of the back heat exchanger.

9. The air conditioner according to claim 7, wherein the ratio is L/D≧0.4, where the external diameter of the blade of the cross-flow fan is D and the maximum distance between a suction panel and the front heat exchanger is L.

* * * * *